US006918145B1

(12) United States Patent
Drangula

(10) Patent No.: US 6,918,145 B1
(45) Date of Patent: Jul. 19, 2005

(54) POSTCOITAL POSITIONING PILLOW

(76) Inventor: Christy Drangula, 93 Glen Rock Rd., Cedar Grove, NJ (US) 07009

( * ) Notice: Subject to any disclaimer, the term of this patent is extended or adjusted under 35 U.S.C. 154(b) by 0 days.

(21) Appl. No.: 10/775,696

(22) Filed: Feb. 11, 2004

(51) Int. Cl.[7] ..... A47C 20/00; A47G 9/00
(52) U.S. Cl. ..... 5/632; 5/655.9; 5/929; 5/953
(58) Field of Search ..... 5/632, 630, 633, 5/652, 655.9, 953, 929

(56) References Cited

U.S. PATENT DOCUMENTS 3,361,471 A * 1/1968 Radford ..... 297/230.12
D211,721 S * 7/1968 Radford ..... D6/601
3,555,582 A * 1/1971 Radford ..... 5/632
5,425,567 A * 6/1995 Albecker, III ..... 297/377
D360,796 S * 8/1995 Goldado ..... D6/601
5,836,653 A * 11/1998 Albecker ..... 297/452.31
6,155,647 A * 12/2000 Albecker, III ..... 297/452.16
6,360,387 B1 * 3/2002 Everhart ..... 5/630
6,675,417 B2 * 1/2004 Spector et al. ..... 5/630
2003/0204912 A1 * 11/2003 Spector et al. ..... 5/630

* cited by examiner

*Primary Examiner*—Robert G. Santos

(57) ABSTRACT

A pillow adapted to allow a female user to comfortably assume a postcoital position that will enhance the likelihood of becoming pregnant. The pillow includes a lower concave portion placed beneath the buttocks of the user to maintain the hips in an elevated position and an upper convex portion having a height of at least 16 inches to support the legs of the user in a generally vertical upright position.

9 Claims, 3 Drawing Sheets

POSTCOITAL POSITIONING PILLOW

FIELD OF THE INVENTION

The present invention relates generally to specialty pillows and more specifically to a pillow that is particularly shaped to allow a female user to comfortably assume and maintain a position after sexual intercourse that will enhance the prospects of becoming pregnant.

BACKGROUND OF THE INVENTION

Quite often, women have difficulty achieving conception despite the fact that no evident physical impediment may exist to cause such difficulty. Many theories have been postulated in the field of reproductive endocrinology and infertility regarding the reasons why woman may find it difficult to conceive. Infertility clinics have proposed numerous expedients to assist woman in achieving conception.

One such expedient that has been proposed is that the woman should remain on her back with her hips and legs raised immediately following sexual intercourse. It has been suggested that this may be achieved by placing a pillow or other similar device beneath the buttocks of the woman and it has been recommended that the woman should remain in this position for 15 to 30 minutes in order to increase the downward angle of the vagina so that semen will pool up against the cervix.

Thus, it has been postulated by various experts that to improve the likelihood of conception, a woman should tilt her pelvis upwardly in order facilitate the entry of the sperm into the uterus and that she should continue to lie on her back in this position for some time sufficient to enhance the movement of the sperm into the vagina and into the cervix and uterus.

However, for a woman to remain in this position for up to 30 minutes can be quite uncomfortable if the only means of support is an ordinary household pillow or the like placed beneath the buttocks.

Thus, due to the discomfort that this position may engender, many woman will find it difficult to maintain the desired position for an adequate period of time or, after attempting to do so once or twice, they may abandon the attempts completely.

It would, therefore, be of significant benefit in this regard if there could be provided a device that would enable a woman to remain in the recommended position for the appropriate period of time without discomfort and with ease.

The present invention is directed toward providing such a device that will be convenient to use and store and that will assure that the desired positioning may be achieved and maintained with ease and without discomfort.

SUMMARY OF THE INVENTION

Briefly, the present invention may be described as a postcoital positioning pillow having a lower concave portion adapted to support the buttocks of a user to maintain the hips in an elevated position and an upper convex portion for supporting the legs of the user in a generally vertical upright position.

The pillow may be formed of foam rubber with a removable terry cloth cover. Handles for facilitating positioning of the pillow may be provided on opposite sides thereof The upper convex portion of the device should be of a height adequate to properly support legs of a user in a generally vertical upright position while the buttocks are supported upon the lower concave portion.

BRIEF DESCRIPTION OF THE DRAWINGS

The invention will be better understood by reference to the following detailed description of the preferred embodiment taken in connection with the accompanying drawings wherein like reference numerals are used to refer to similar parts throughout the various figures thereof.

In the drawings.

DETAILED DESCRIPTION OF THE PREFERRED EMBODIMENT

Figure 1:
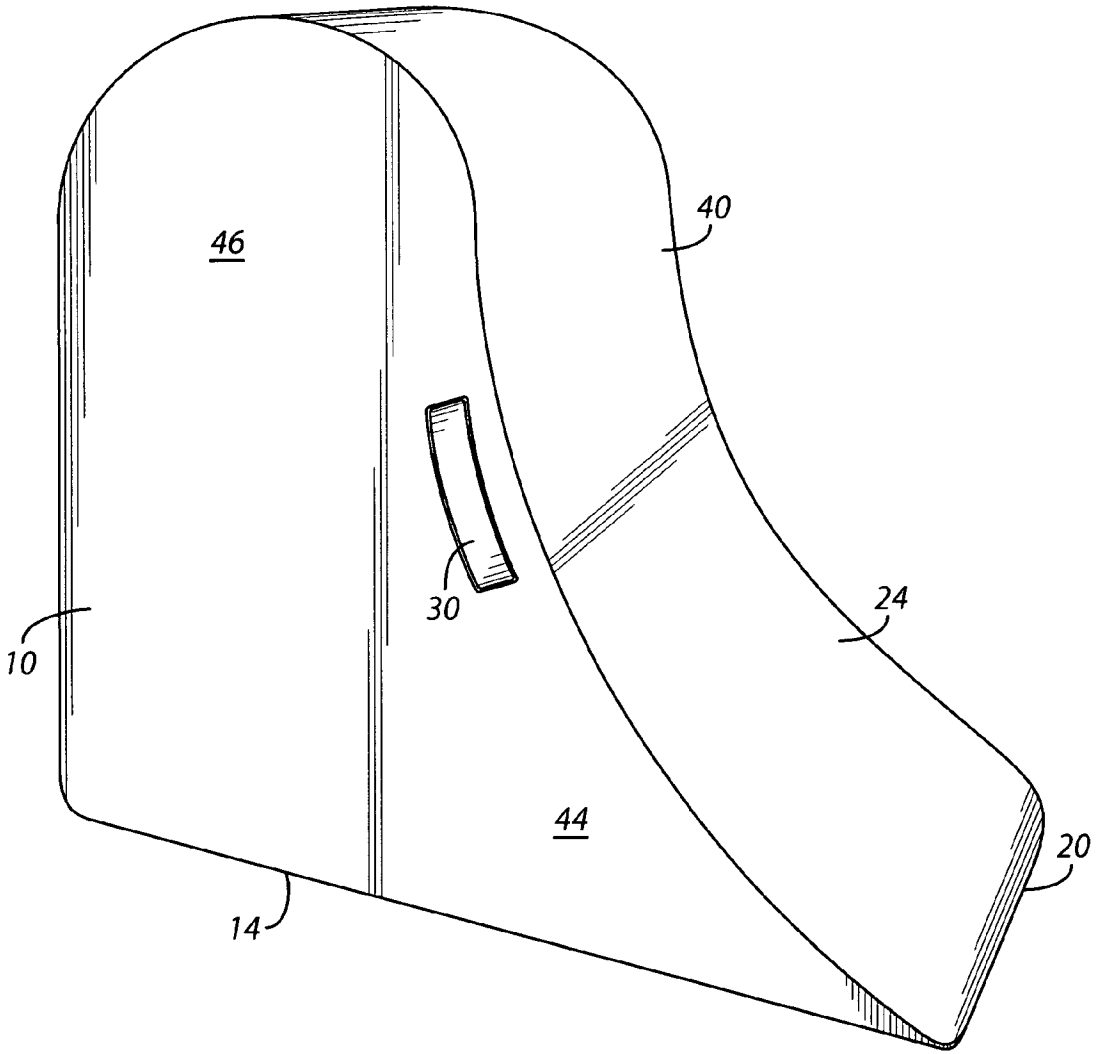
FIG. 1 is a perspective view showing a pillow in accordance with the present invention.
Figure 3:
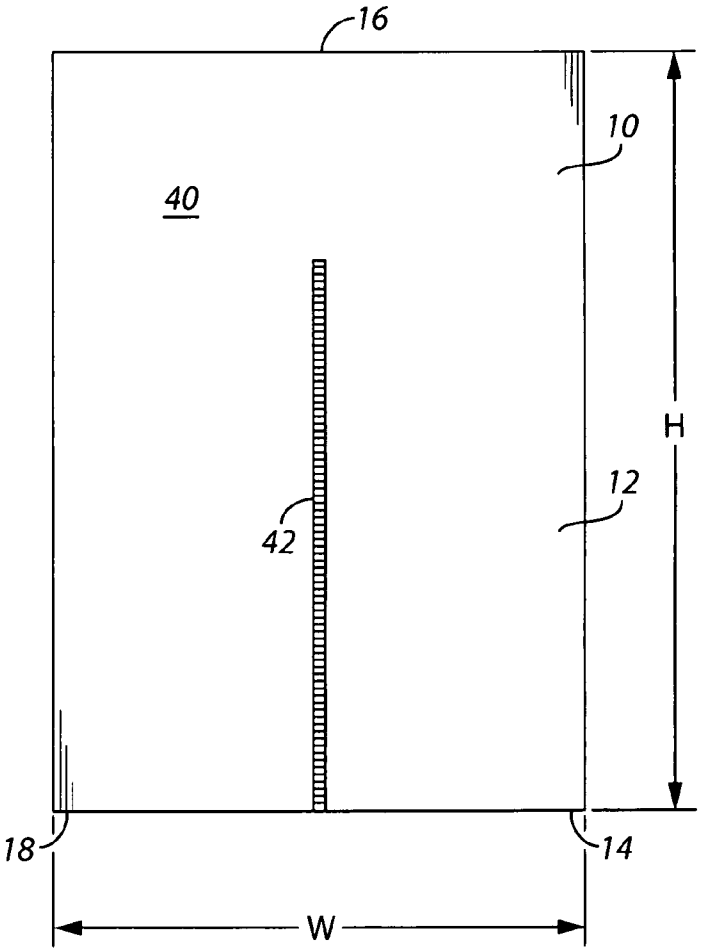
FIG. 3 is a view of the back of the pillow shown in FIG. 1.
Figure 2:
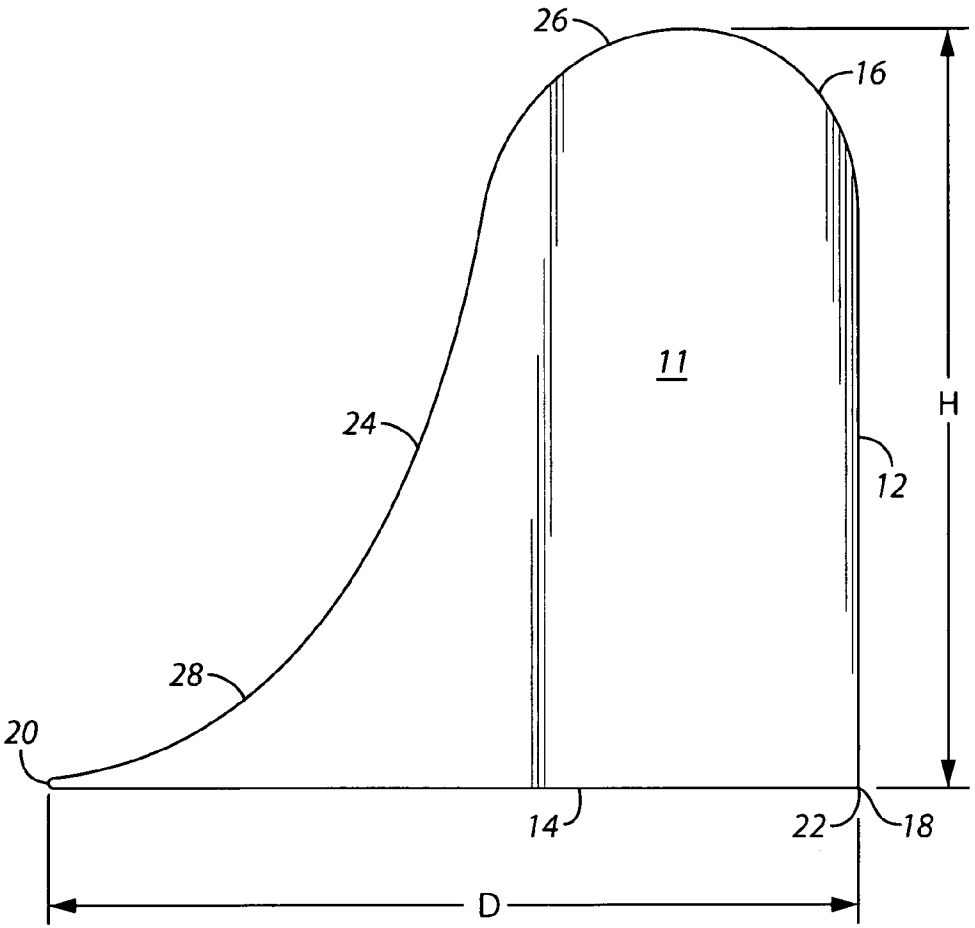
FIG. 2 is a side elevation showing the foam rubber base of the pillow shown in FIG. 1.

Referring now to the drawings, and particularly to FIGS. 1, 2, and 3 thereof, the invention is shown as comprising a pillow 10 having a first planar surface 12 adapted to be in a vertically upright position when the pillow is in use and a second planar surface 14 adapted to be located horizontally when the pillow 10 is in use.

As will be apparent from the drawings, the first planar surface 12 has an upper edge 16 and a lower edge 18 and the second planar surface 14 has a front edge 20 and a rear edge 22. With reference particularly to FIG. 2, it will be seen that the lower edge 18 of the surface 12 and the rear edge 22 of the surface 14 are coincident with each other.

The pillow 10 is also formed with a curved surface 24 extending continuously from the upper edge 16 to the front edge 20. The curved surface 24 includes an upper convex section 26 and a lower concave section 28. The lower convex section 28 ends at a lower edge that is coincident with the front edge 20 thus tapering to form a very thin lower portion of the pillow 10.

A pair of positioning handles 30, 32 are provided on opposite sides of the pillow 10.

Figure 4:
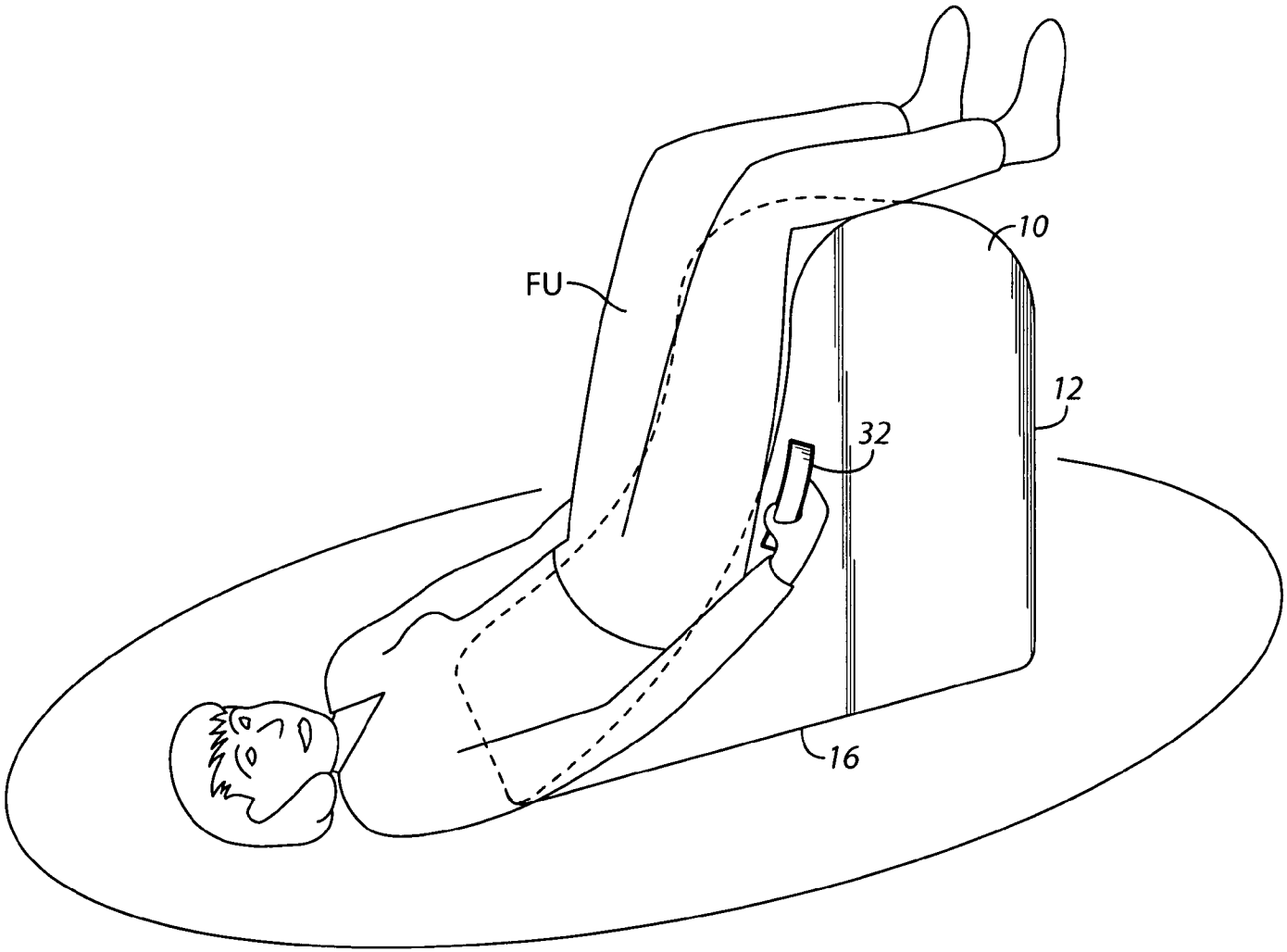
FIG. 4 is a perspective view showing the pillow of FIG. 1 in use.

FIG. 4 shows the pillow of the present invention in actual use. As indicated therein, a female user FU may comfortably lie on her back with her legs in a generally vertical upright position supported upon the upper convex section 26 and with her buttocks supported upon the lower concave section 28 to elevate the hips. With the pillow of the present invention, the user may easily and comfortably retain this position for the recommended time without discomfort or effort.

With the user FU in this position, the concave section 28 will extend beneath the buttocks to maintain the hips in an elevated position and simultaneously the convex section 26 of the curved surface 24 will comfortably support the legs in a generally vertical upright position. By gripping the handles 30, 32, the user may easily locate the pillow 10 into a desired position to provide the proper support.

An important aspect of the present invention is the proper dimensioning of the pillow 10 so as to provide the proper support for the user. In accordance with the preferred embodiment of the invention, the pillow 10 should have a height H of at least 16 inches. This is important so that the legs of the user may be maintained in the proper upright position while at the same time proper support therefore may be provided. However, depending upon the size of the user, the height may be provided to be between 16 and 20 inches and preferably about 17 inches without departing from the spirit and scope of the present invention.

In the preferred embodiment of the invention illustrated in the drawings, the pillow 10 should have a width W of between 14 and 18 inches and preferably 16 inches.

The depth D of the pillow 10 should be between 18 and 25 inches and preferably 20 inches.

Also, the pillow 10 should have at, at the upper portion thereof, a thickness T extending between the convex section 26 and the planar surface 12 of between 8 and 12 inches and preferably 9 inches.

The pillow 10 may be made of a material such as foam rubber and may be provided with a cover 40 made of cloth such as terry cloth. The cover maybe provided with fastening means 42 such as a zipper or the like to make the cover 40 removable and replaceable for laundering. The handles 30, 32 may be attached by any appropriate means, such as sewing, to the cover 40.

FIG. 2 shows the foam rubber base 11 of the pillow 10 and FIGS. 1,3 and 4 show the pillow with the foam rubber base 11 enclosed within the cloth cover 40.

The pillow 10 should be used as soon as possible after sexual intercourse to enhance the likelihood of conception. A user should remain in the position illustrated in FIG. 4 for between 15 and 30 minutes, according to theories postulated by experts in the field.

As will be apparent from the drawings, the device of the present invention is essentially formed with a lower portion 44 formed with the concave section 24 and an upper portion 46 extending upwardly from the lower portion 44 when in use and formed integrally therewith. These two portions, in combination, essentially comprise the structure of the present invention and operate in a synergistic manner to enable the device of the invention to provide the desired function. As will be apparent from FIGS. 1 and 2, the lower portion 44 is formed so that the concave section 24 will taper to a narrow, thin end coincident with the edge 20 to form an attenuated configuration with said second planar surface 14 to facilitate placement of the lower portion 44 beneath the buttocks of a user.

While the present invention has been described herein with reference to a preferred embodiment thereof, it should be understood that various changes and modifications may be provided without departing from the spirit and scope of the invention as the defined in the appended claims.

What is claimed is:

1. A device for postcoital positioning of a female user comprising:

a first surface extending vertically while said device is in use, said first surface having an upper and a lower edge;

a second surface extending horizontally when said device is in use and extending perpendicularly relative to said first surface, said second surface having a front and a rear edge;

with said lower edge of said first surface extending contiguously with said rear edge of said second surface; and a continuous curved surface extending upwardly from said upper edge of said first planar surface to said front edge of said second surface;

said curved surface having a convex configuration adjacent said upper edge adapted to support the legs of a user in a generally upright position and a concave configuration extending continuously with said convex configuration ending at said front edge and tapering to form a thin lower portion of said pillow to simultaneously maintain the buttocks of a user in an elevated position.

2. A device according to claim 1 comprising a base member made of foam rubber.

3. A device according to claim 2 comprising a removable cover extending about said foam rubber base member and enclosing said base member therein.

4. A device according to claim 1, comprising a width of between 14 and 18 inches and a height of between 16 and 20 inches.

5. A device according to claim 1 wherein said first surface and said second surface have a width of between 14 and 18 inches; wherein said first surface has a height of between 16 and 20 inches; wherein said second surface has a depth of between 18 and 25 inches; said device further comprising a thickness extending between said first surface and said curved surface of between 8 and 12 inches.

6. A device according to claim 1, 3, or 5 comprising a pair of handles located on opposite sides thereof to facilitate use of said device.

7. A device according to claim 1 wherein said concave configuration tapers toward said front edge to meet said second surface to form therewith said very thin lower portion.

8. A device according to claim 2 comprising a pair of handles located on opposite sides thereof to facilitate use of said device.

9. A device according to claim 4 comprising a pair of handles located on opposite sides thereof to facilitate use of said device.

* * * * *